US009506014B1

(12) United States Patent
Ashry et al.

(10) Patent No.: US 9,506,014 B1
(45) Date of Patent: Nov. 29, 2016

(54) BOTTLE CLEANING POWDER AND TABLET

(71) Applicant: Crystal Clear Laboratories L.L.C., Montvale, NJ (US)

(72) Inventors: Mohamed Rustom Ashry, River Vale, NJ (US); Mohammed Ragab Elshaer, River Vale, NJ (US)

( * ) Notice: Subject to any disclaimer, the term of this patent is extended or adjusted under 35 U.S.C. 154(b) by 0 days.

(21) Appl. No.: 15/146,275

(22) Filed: May 4, 2016

(51) Int. Cl.

| | |
|---|---|
| ***C11D 1/12*** | (2006.01) |
| ***C11D 3/10*** | (2006.01) |
| ***C11D 3/386*** | (2006.01) |
| ***C11D 3/39*** | (2006.01) |
| ***C11D 3/20*** | (2006.01) |
| ***C11D 3/04*** | (2006.01) |

(52) U.S. Cl.
CPC ..... *C11D 1/12* (2013.01); *C11D 3/046* (2013.01); *C11D 3/10* (2013.01); *C11D 3/2086* (2013.01); *C11D 3/386* (2013.01); *C11D 3/3942* (2013.01)

(58) Field of Classification Search
CPC ..... C11D 1/12; C11D 3/042; C11D 3/10; C11D 3/386; C11D 3/39
See application file for complete search history.

(56) References Cited

U.S. PATENT DOCUMENTS 5,898,025 A * 4/1999 Burg ..... C11D 3/3917 510/220

* cited by examiner

*Primary Examiner* — Brian P Mruk
(74) *Attorney, Agent, or Firm* — James M. Smedley LLC; James Michael Smedley, Esq.

(57) ABSTRACT

The present invention relates to a quick rinse detergent cleaner. The detergent contains high levels of salt that immediately collapse soap bubbles, so that less rinsing (and re-rinsing) of utensils is required. This allows for greater portability and applications relative to existing cleaning solutions.

6 Claims, No Drawings

BOTTLE CLEANING POWDER AND TABLET

FIELD OF INVENTION

The present invention generally relates to an all-natural cleaning solution, especially for use with baby bottles, which is formulated to provide for multiple types of cleaning reactions with minimal water usage.

BACKGROUND OF THE INVENTION

Caring for a baby requires significant preparation. Such preparation includes being equipped with as much food and supplies as can be reasonably determined to address a baby's caretaking needs. Equally as important is ensuring that the food and supplies are adequately hygienic for the baby.

Baby bottles are one such supply that requires particular attention. Due to the relatively high concentrations of protein and sugars in milk compared to water, residual organic debris can attract bacteria and other microbial organisms leading to infections or sickness.

Maintaining cleanliness of baby bottles can prove to be challenging when on-the-go since there is only a limited amount space available to pack for necessary resources. Leftover milk and other organic material have the tendency to adhere onto bottle surfaces, making it difficult to wash away the organic material unless a detergent is used. This may require a significant amount of water resources. To address this concern, the caretaker may store extra water, soap and cleaning utensils; however, the limited space when traveling may make it difficult to maintain an ample supply of water in conjunction with the various cleaning items. To solve for this problem, the caretaker can stores extra clean bottles when on-the-go. However, the caretaker then faces the same situation of limited storage.

Accordingly, there is a need in the art for a cleaning product that delivers cleansing power with relatively little water. These and other features and advantages of the present invention will be explained and will become obvious to one skilled in the art through the summary of the invention that follows.

SUMMARY OF THE INVENTION

The present invention provides a cleaning detergent that is designed to allow for rapid cleaning while on-the-go or in transit. The invention works by a three-fold cleaning mechanism to provide thorough cleaning and disinfection. Additionally, the present invention is formulated to be easily rinsed off, thereby minimizing the need for re-rinsing.

According to an embodiment of the claimed invention, a multi-action cleaning detergent is comprised of citric acid, sodium bicarbonate, sodium citrate, protease, sodium lauryl sulfoacetate, sodium percarbonate, and magnesium sulfate.

According to an embodiment of the claimed invention, the multi-action cleaning detergent is further comprised of microcrystalline cellulose.

According to an embodiment of the claimed invention, the multi-action cleaning detergent is further comprised of stearic acid.

According to an embodiment of the claimed invention, the multi-action cleaning detergent is comprised of both microcrystalline cellulose and stearic acid.

According to an alternate embodiment of the claimed invention, a multi-action cleaning detergent is comprised of about 19 weight % to about 22 weight % citric acid (+/−10 weight %); about 15 weight % to about 17 weight % sodium bicarbonate (+/−10 weight %); about 14 weight % to about 16.5 weight % sodium percarbonate (+/−10 weight %); about 6 weight % to about 7 weight % sodium citrate (+/−10 weight %); about 3 weight % to about 3.5 weight % magnesium sulfate (+/−10 weight %); about 2.8 weight % to about 3.2 weight % protease (+/−10 weight %); and about 0.9 weight % to about 1.1 weight % sodium lauryl sulfoacetate (+/−10 weight %).

According to an alternate embodiment of the claimed invention, the alternate embodiment is further comprised of about 32 weight % to about 36 weight % (+/−10 weight %) of microcrystalline cellulose.

According to an alternate embodiment of the claimed invention, the alternate embodiment is further comprised of about 0.22 weight % to about 0.28 weight % of stearic acid (+/−10 weight %).

According to an alternate embodiment of the claimed invention, the alternate embodiment is further comprised of both approximately 32 weight %-36 weight % of microcrystalline cellulose (+/−10 weight %) and approximately 0.22 weight %-0.28 weight % of stearic acid (+/−10 weight %).

According to another alternate embodiment of the claimed invention, the other alternate embodiment is comprised of about 20 weight % (+/−10 weight %) of citric acid; about 32.34 weight % (+/−10 weight %) of sodium bicarbonate; about 30.70 weight % (+/−10 weight %) of sodium percarbonate; about 6.66 weight % (+/−10 weight %) of sodium citrate; about 3.35 weight % (+/−10 weight %) of magnesium sulfate; about 6 weight % (+/−10 weight %) of protease; and about 1 weight % (+/−10 weight %) of sodium lauryl sulfoacetate.

According to yet another alternate embodiment of the claimed invention, this alternate embodiment is comprised of about 20 weight % (+/−10 weight %) of citric acid; about 18.75 weight % (+/−10 weight %) of sodium bicarbonate; about 17.5 weight % (+/−10 weight %) of sodium percarbonate; about 6.66 weight % (+/−10 weight %) of sodium citrate; about 3.35 weight % (+/−10 weight %) of magnesium sulfate; about 6 weight % (+/−10 weight %) of protease; and about 1 weight % (+/−10 weight %) of sodium lauryl sulfoacetate.

According to another alternate embodiment of the claimed invention, the other alternate embodiment is further comprised of about 34.2 weight % (+/−10 weight %) by weight of microcrystalline cellulose.

According to another alternate embodiment of the claimed invention, the other alternate embodiment is further comprised of about 0.25 weight % (+/−10 weight %) by weight of stearic acid.

DETAILED DESCRIPTION OF THE INVENTION

It is to be understood that the disclosed embodiments are merely exemplary and details disclosed herein are not to be interpreted as limited, but merely as a representative basis for teaching one skilled in the art.

The present invention relates to a multi-action detergent designed for easier cleaning while in-transit. Specifically, the invention relates to a detergent with three main features: (i) tri-level cleaning activity designed to eliminate milk and other organic residue; (ii) quick-rinse ability requiring relatively little water compared to the prior arts; and (iii) comprising of all natural ingredients. The preferred embodiment of the formulation is a powdered tablet form. However, the formulation may also be in liquid or loose powder form.

The multiple action cleaning detergent comprises of essentially of the following components: (a) an acid and base to yield effervescent action; (b) an oxidative agent to disinfect; (c) an enzyme that degrades particulate matter; (d) a surfactant that acts as a detergent and foaming agent; and (e) salt that destabilizes the foam and facilitates quick removal of the formulation from a cleaned utensil.

The first feature of the invention is tri-level cleansing actions by different mechanisms upon application and use. First, cleaning is achieved through physical agitation as a result of two separate activities: (i) effervescent action and (ii) foaming action. In both actions, mechanical motion contributed by bubbles agitate and remove adhered residue without sticking to the utensil themselves. Second, cleaning is aided by enzymatic digestion of residual proteinaceous matter. This digestion dissolves or breaks down protein particles into smaller subunits, which are trapped within micelles created by the surfactant, and rinsed away. Third is the process of oxidative disinfection, which effectively kills off microbial cells, some of which have the potential of being pathogens.

In detail, the first level of cleaning employs abrasive activity that mechanically scrubs off organic residue. There are two sources of abrasive activity that contribute to the cleaning effect of the present invention: (i) effervescent activity and (ii) foaming activity. Effervescent action results when an acid combines with a base, releasing gas in a liquid environment. In the powdered tablet embodiment of the claimed invention, the acid and base are in suspended configuration; therefore, they remain inert. However, with the addition of water, the acid and base dissociate into their ionic form and react to create an implosion of small bubbles (typically carbon dioxide). These bubbles rub against a surface and loosen hardened material. Subsequently, the loosened hardened material is suspended in water and prevented from re-adhering to the inner walls of the container only to be rinsed out.

In the preferred embodiment, citric acid and sodium bicarbonate are the acid/base components required in roughly similar percentages (relative to the total weight of the invention) to create the effervescent solution. Approximately 19 weight %-22 weight % of citric acid is combined with approximately 15 weight %-17 weight % of sodium bicarbonate to generate effervescent action. Proper pH level is attained when approximately 6 weight %-7 weight % of the final formulation is comprised of sodium citrate.

The second abrasive activity occurs from the contact between surface and foam. Foam is generated when the claimed invention is dissolved in water and then shaken. This shaking action introduces air pocket into the dissolved formulation, and with the presence of a foaming agent (e.g. a surfactant) which stabilizes the air pockets, foam is created. Cleaning is accomplished by the collision of the foam bubbles against a surface. When a gas-filled bubble collides with a surface, this collision destabilizes the bubble, transitioning it into a liquid state. The force of such transition is sufficient to dislodge a particulate matter.

In the preferred embodiment, about 0.9 weight % to about 1.1 weight %, of the formulation is comprised of sodium lauryl sulfoacetate (SLSA) as the surfactant of choice to stabilize foam. The SLSA also serves as a detergent, allowing for the emulsification of any lipophilic particulate matter into micelles. Once a particulate matter is dislodged, the foam and the surfactant collectively emulsify such loose matter to prevent it from reversibly adhering back onto the cleaned surface.

Although sodium lauryl sulfate (SLS) is conventionally utilized as the surfactant of choice, it is harsher substance compared to SLSA, and therefore less desirable in a cleaning aid. This is due to SLS's relatively smaller polar head. When the polar head is smaller, the ionic charge of the substance concentrates in the relatively smaller area, contributing to the irritancy of the product. In contrast, SLSA has a comparatively larger polar head than SLS, making it a gentler product for use.

In other embodiments, other anionic surfactants may be present with the SLS in total amounts between 0.9 weight % to about 1.1 weight %. Further embodiments may include substituting SLS with another anionic surfactant or combination of other surfactants. Examples of acceptable anionic surfactants include ammonium lauryl sulfate, sodium lauryl sulfate, sodium lauryl ether sulfate (SLES), and sodium myreth sulfate.

With respect to the second level of cleaning, residual proteinaceous matter from milk is degraded by the presence of proteases in the formulation. The proteases act by the hydrolytic cleaving of peptide bonds between amino acids. Any of the various classes of proteases are included in the formulation. Further, the formulation may comprise of one or more various classes of proteases which may include (but is not limited to) cysteine protease, serine protease, threonine protease, aspartic protease, and metalloprotease. In the preferred embodiment, approximately 2.8 weight %-3.2 weight % of the lyophilized protease of the *Bacillus polymyxa* is incorporated within the cleaning formulation.

In alternate embodiments, different or additional types of enzymes can be used. For example, amylase can be used additionally or as a substitute for the protease in the current invention. Amylase works through hydrolysis to degrade carbohydrates. During cleaning with the formulation, certain amylases catalyze the hydrolysis of alpha-1,4-bonds in starch, leading to the decomposition of starch into soluble dextrins and oligosaccharides. Dextrins and oligosaccharides are easily soluble in water and are therefore easier to remove from the utensil during wash.

In another alternate embodiment, lactase can be used in lieu of, or in addition to, the protease. Lactose is the predominant sugar in milk. Since there are approximately seven (7) grams of lactose per 100 mL of milk, much of milk soil may be eliminated by the use of lactase. The lactase enzyme acts to break down beta D-galactosidic substances (e.g. lactose) by catalyzing the hydrolysis of beta-D-galactoside into a D-galactose and an alcohol. It is envisioned that an embodiment of the formulation consist of protease, amylase, and lactase.

In further alternate embodiments, the formulation may comprise of lipase, an enzyme that degrades fats. In general, milk contains approximately 4 weight % milk fat. Accordingly, lipase increases the efficiency of the formulation by target the fatty particles of milk soil. As with the other mentioned enzymes, lipase work through hydrolysis. Specifically lipase catalyzes the hydrolysis of fats (e.g. triglycerides, fats, and oils) into glycerol and fatty acids. Additionally, lipase provides the benefit of working in a low temperature environment. Therefore, in the situation where only cold water is available for cleaning, the enzymatic activity of the formulation can still be harnessed.

With respect to the third level of cleaning, oxidative disinfection is provided by the action of sodium percarbonate. As an oxidizing agent, sodium percarbonate removes electrons from susceptible chemical compounds that are essential for viability, thereby decreasing the level of contaminating microorganisms. Sodium percarbonate is proposed to have multiple targets within a cell with the effect of killing off a microorganism. This includes peroxidation and disruption of the membrane layers, oxidation of oxygen scavengers and thiol groups, enzyme inhibition, oxidation of nucleosides, impaired energy production, and disruption of protein synthesis which can, either individually and especially altogether, achieve cellular death.

In the preferred embodiment of a tablet formulation, approximately 14 weight %-16.5 weight % of the formulation comprises of sodium percarbonate. The breaking down of sodium percarbonate into hydrogen peroxide and sodium carbonate provides a layer of cleaning activity. Hydrogen peroxide has been demonstrated to have lethal effects on a great range of microorganisms such as viruses, bacteria, yeasts and bacterial spores by producing destructive hydroxyl free radicals. These radicals attack membrane lipids, deoxyribose nucleic acid (DNA), and essential cell components to provide germicidal effectiveness. As such, in an alternate liquid embodiment of the claimed invention, hydrogen peroxide is used in lieu of sodium percarbonate.

It is believed that the oxidative disinfection properties of the claimed invention result in the reduced population of disease causing agents. A laboratory analysis of the efficacy of the claimed invention reveals that the viability of the microorganisms *Escherichia coli* (*E. coli*) and *Staphylococcus aureus* (*S. aureus*) is significantly reduced upon contact. Such finding is important as it emphasizes the cleaning power of the claimed invention. Strains of both *E. coli* and *S. aureus* are able to secrete toxins in food, leading to food poisoning and potentially death. Accordingly, the antimicrobial properties of the claimed invention demonstrate the enhanced and thorough cleaning properties of the claimed invention.

The antimicrobial activities of the preferred embodiment of the invention are summarized in Table 1. To perform the analysis, a tablet of the claimed invention weighing 1.5 grams (+/−0.2 grams) was suspended in one (1) oz. of water. Viability of test organisms were evaluated using the protocol for Assessment of Antimicrobial Activity using a Time-Kill Procedure (ASTM International Method E2315).

TABLE 1

| Test Organism | Test Substance | Contact Time | Percent Reduction Compared to Control at Time Zero |
|---|---|---|---|
| *E. coli* | Control | Time Zero | N/A |
| | Claimed Invention | 2 Minutes | 10.53% |
| | Claimed Invention | 10 Minutes | 98.14% |
| *S. aureus* | Control | Time Zero | N/A |
| | Claimed Invention | 2 Minutes | 78.38% |
| | Claimed Invention | 10 Minutes | 98.22% |

The results conclusively show a drastic decrease in the population of viable cells relative to an untreated group. At the two minute mark, the efficacy of the invention differs across the different species of organisms. The invention is more effective as an antimicrobial agent against *S. aureus* than *E. Coli* during the first two minutes of cleaning. However, after a ten minute exposure, both strains were effectively reduced by greater than 98%.

The second feature of the invention is the "quick rinse" ability of the formulation which permits it to completely rinse off with relative little water usage. This quick rinse is facilitated by the rapid collapse of soap bubbles that are easily and thoroughly rinsed. In preferred embodiments, approximately two (2) oz of water are required per application (e.g. cleaning of a single baby bottle) to collapse detergent bubbles and effectively rinse out the formulation after use.

It is believed that the four-fold increase in the relative quantity of salt by weight over the prior art yields the quick rinse ability of the claimed formulation. When the formulation is activated by water and then agitated, this introduces air pockets which are stabilized by the surfactant resulting in foam. This resulting foam is four times more dense than traditional soap and more uniform, allowing for a consistent erosion rate of adhered debris. However, the activation also releases salt, which increases the ionic strength of the resulting foam. The increase in ionic strength in turn causes the foam to become more dense, yet more unstable, leading to the rapid collapse of the foam bubbles. As a result of the collapse, the increased drainage facilitates the quick removal of the dense and compacted foam. An additional rinse thoroughly eliminates any remaining residue. In the preferred embodiment, the salt of choice is magnesium sulfate which comprises of approximately 3 weight %-3.8 weight % of the formulation.

And lastly, the third feature of the invention is a formulation comprising of all-natural ingredients. Since babies as a group are considered to be more sensitive to chemicals than the general population, each component of the present invention in the preferred and alternate embodiments is all-natural. For the purposes herein, "all-natural" is defined as low level toxicity. As such, the formulation is comprised of ingredients in quantities that have been adequately shown to be safe under conditions of intended use.

In the preferred embodiment, the formulation is provided in solid form. The preferred solid form is a tablet embodiment comprising approximately 32 weight % to 36 weight % of microcrystalline cellulose. Each tablet embodiment weight approximately 1.5 grams (+/−0.2 grams). Both solid embodiments are intended to be reconstituted in water upon use. However, concentrated and diluted versions in liquid form are also envisioned.

In an illustrative method embodiment for an eight (8) oz baby bottle, the formulation (in tablet form) is introduced to two (2) oz of fresh water. The bottle is sealed and shaken until the tablet dissolves. During the approximately 1-2 minutes it takes for the tablet to dissolve, the three fold cleaning activities are happening, thereby stripping the bottle of organic residue in the interim. After the dissolution of the tablet is complete, the contents are discarded. The bottle is rinsed for 5-10 seconds with an additional one (1) oz of water, which is sufficient to eliminate all the debris and suds. After the rinsing water is discarded, the bottle is fit for use.

As a comparison, the rinsing abilities of the current invention were analyzed against 300 mg of a leading dish soap. After discarding the initial contents, the traditional detergent required three separate rinses with two (2) oz of water at each interval to remove the suds and debris, whereas the current invention only required one rinse of one (1) oz. Therefore, for each ounce of water required the rinsing with the current invention, traditional detergent requires six times this amount.

In an alternative illustrative method embodiment, the resulting solution after the tablet dissolves remains within the container for 10 minutes before discard. Pursuant to assays of antimicrobial activity, a 10 minute incubation period is sufficient to reduce certain microbial population by 98%. Accordingly, this 10 minute incubation will have enhanced cleaning activity. While not necessary, the container with the invention may be agitated to thoroughly coat the surface of the soiled container.

The current invention has added benefits over traditional soap cleaners. It is notable that the current invention leaves relatively less water droplets on the cleansed apparatus compared to traditional soap cleaners. Essentially, conventional cleansing of utensils leaves water droplets behind that must either be wiped dry or left out to evaporate, leaving spots. However, the current invention has fast acting drying capabilities such that much of the water that would ordinary remain slides off. Further, whereas traditional soap cleaners may leave a fragrance which can be oft-putting to a baby or toddler, the current invention in the preferred embodiment leaves no residual odor.

Further embodiments of the claimed invention may also include 0.22 weight % to about 0.28 weight % of steric acid. Steric acid is a waxy substance that serves two distinct roles. Initially, the presence of this ingredient serves more of a processing role than as a cleaning role. During manufacturing, the friction between the formulation components and the metal may damage the manufacturing equipment and introduce impurities within the formulation. The steric acid serves to reduce the harsh interactions between the formulation ingredients and the manufacturing equipment. During actual use of the invention, the steric acid functions a lubricant that prevents dislodged particles from re-adhering to a surface.

In other alternate embodiments, one or more of the following components are doubled relative to the preferred embodiment: protease, sodium percarbonate, and sodium bicarbonate to a formulation comprising of about 20 weight % (+/−10 weight %) of citric acid; about 6.66 weight % (+/−10 weight %) of sodium citrate; about 3.35 weight % (+/−10 weight %) of magnesium sulfate. Accordingly, the final formulation may include protease at about 5.6 weight % to about 6.4 weight %, and/or sodium percarbonate at 28 weight % to about 33 weight %, and/or sodium bicarbonate at 30 weight % to about 34 weight %.

In yet another alternate embodiment, only the protease is doubled whereas the sodium bicarbonate and sodium percarbonate are increased by 25% relative to the preferred embodiment. The final formulation for this embodiment is 20 weight % (+/−10 weight %) of citric acid; about 6.66 weight % (+/−10 weight %) of sodium citrate; about 3.35 weight % (+/−10 weight %) of magnesium sulfate, about 6 weight % of protease, sodium percarbonate at 17.5 weight %, and sodium bicarbonate at 18.75 weight %.

Additional embodiments of the claimed invention include other components to impart other desirable properties. These components may include scented variations. For example, it is envisioned that commercial embodiments may include, herbal scents such as lavender.

As used herein, analogs are defined to include, but are not limited to molecules that are chemically distinct from an identified substance, but which exert the same biological activity.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A multiple action cleaning detergent formulation comprising of:

(a) Citric acid
(b) Sodium bicarbonate
(c) Sodium citrate
(d) Protease
(e) Sodium lauryl sulfoacetate
(f) Sodium percarbonate and
(g) Magnesium sulfate.

2. The cleaning detergent formulation of claim 1, further comprising of about 3 weight % to about 3.8 weight % of magnesium sulfate.

3. The cleaning detergent formulation of claim 1 further comprising of microcrystalline cellulose.

4. The cleaning detergent formulation of claim 3 further comprising of stearic acid.

5. The cleaning detergent formulation of claim 1 further comprising of stearic acid.

6. A multiple action cleaning detergent formulation comprising, by weight:

(a) about 19 weight % to about 22 weight % of citric acid;
(b) about 15 weight % to about 17 weight % of sodium bicarbonate;
(c) about 14 weight % to about 16.5 weight % of sodium percarbonate;
(d) about 6 weight % to about 7 weight % of sodium citrate;
(e) about 3 weight % to about 3.5 weight % of magnesium sulfate;
(f) about 2.8 weight % to about 3.2 weight % of protease; and
(g) about 0.9 weight % to about 1.1 weight % of sodium lauryl sulfoacetate.

* * * * *